United States Patent [19]

van der Meulen

[11] 4,170,927

[45] Oct. 16, 1979

[54] APPARATUS FOR DEPOSITING LENGTHS OF FOIL MATERIAL

[76] Inventor: Leonard van der Meulen, Immeuble Saadi el Menzah, Appt. 22A, 6 éme Etage, Tour A, Tunis, Tunisia

[21] Appl. No.: 879,994

[22] Filed: Feb. 22, 1978

[30] Foreign Application Priority Data

Feb. 22, 1977 [NL] Netherlands ..... 7701897

[51] Int. Cl.[2] ..... B31B 21/14

[52] U.S. Cl. ..... 93/33 H; 83/95; 93/93 HT; 156/515; 198/422; 414/32; 271/196

[58] Field of Search ..... 93/33 H, 93 HT, 8 R; 156/515, 583; 83/95; 214/6 FS, 1 BV, 8; 271/196; 198/422

[56] References Cited

U.S. PATENT DOCUMENTS

| | | | |
|---|---|---|---|
| 3,633,731 | 1/1972 | Jones | 214/1 BV X |
| 3,675,522 | 7/1972 | Hull | 271/196 X |
| 3,921,827 | 11/1975 | Joice | 214/6FS |
| 4,023,470 | 5/1977 | van der Meulen | 93/33 H X |

*Primary Examiner*—Frank T. Yost

*Attorney, Agent, or Firm*—Pollock, Vande Sande & Priddy

[57] ABSTRACT

An apparatus for depositing and batching lengths or sheets of foil material at a collecting station, said material being delivered by a production machine in an uninterrupted flow, the apparatus comprising a rotatably mounted supporting structure provided with pivotally arranged support members which together constitute a cylindrical mantle face, said support members being able to unfold themselves for cooperation with stationary collecting pins along the periphery of said supporting structure, after which said support members collapse again.

6 Claims, 7 Drawing Figures

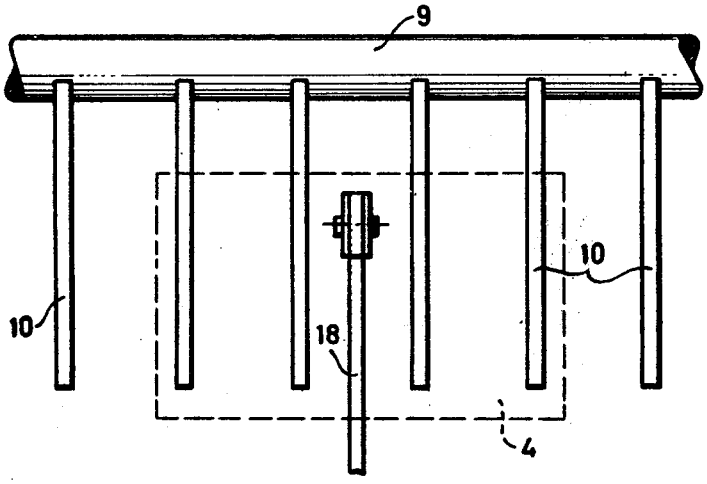
Fig: 5.
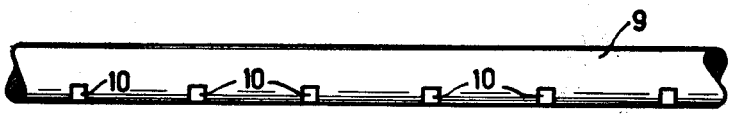
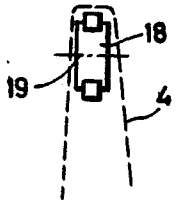
Fig: 6.

APPARATUS FOR DEPOSITING LENGTHS OF FOIL MATERIAL

DISCLOSURE OF THE PRIOR ART

The invention relates to an apparatus for depositing and batching lengths or sheets of foil material at a collecting station, particularly bags of thermoplastic material which are delivered by a production machine in an uninterrupted flow. This apparatus comprises a rotatably mounted supporting structure with a mantle face to which foil material is supplied during the production.

In an apparatus of this type technical problems occur since the production machines mostly deliver sheets of foil material (bags) at a very high velocity, so that generally very little time is left for gripping, stopping and batching of the lengths of material, the handling of which is difficult. In connection herewith, reference may be made to my earlier Netherlands Patent Application No. 71,02415 and to German Pat. No. 2,318,389, in which a rather voluminous mechanism is applied.

SUMMARY OF THE INVENTION

The invention is intended to provide a structurally simple but also reliable solution for the problem indicated above. According to the invention, this is achieved in that the supporting structure along the mantle face is provided with unfoldable support members, each of which is arranged pivotally on an axis directed according to a generatrix of said mantle face. Said support members substantially constitute in a collapsed position the said mantle face, control means being provided for unfolding the said support members in a first zone before the collecting station and folding them back again in a second zone beyond this station.

Owing to these features, supplied sheets of foil material are deposited upon the cylindrical or polygonal mantle face of the supporting structure which is an assembly of many parts (support elements), thereby providing ample opportunity for feeding the sheets of foil material to the receiving members of the collecting station.

In an embodiment of the apparatus according to the invention, the control means for the support members comprise a fixed cam path along at least one part of the circular track of the support members and a lever on the axis of each support member, having a follower roller which cooperates with the cam track for controlling the unfolding and re-folding movement of each support member in the said zones of the circular track. Unfolding of the support members is caused by the available centrifugal force; consequently only a first arcuate zone of limited length is required. For the re-folding movement, a larger arcuate zone (i.e., more time) is available.

The foil material may be supplied by a production machine as a series of separate lengths severed in advance, for instance bags, which series of bags is then deposited successively upon the support members, e.g., in the manner described in my earlier Dutch Patent Application No. 75,00542. The foil material can possibly, if designed, be supplied to the supporting structure as a coherent web. In the latter case, an anvil may be provided between the adjacent support members along the mantle face of the supporting structure, for cooperation with a knife for heat-sealing, which moves synchronously along with the supporting structure before the first zone of the circular track and by means of which so-called side-weld (heat-sealed) bags are produced. In this latter case, the width of each sheet of plastic material may be determined by the ratio of the supply velocity with respect to the circumferential velocity of the supporting structure.

BRIEF INTRODUCTION TO THE DRAWINGS

FIG. 1 is a side elevation of the supporting structure for a so-called "side-weld" ( heat-sealing) machine.

FIGS. 5 and 6 show two views of a variant of the collecting station according to FIGS. 1–4.

DESCRIPTION OF A PREFERRED EMBODIMENT

Figure 2:
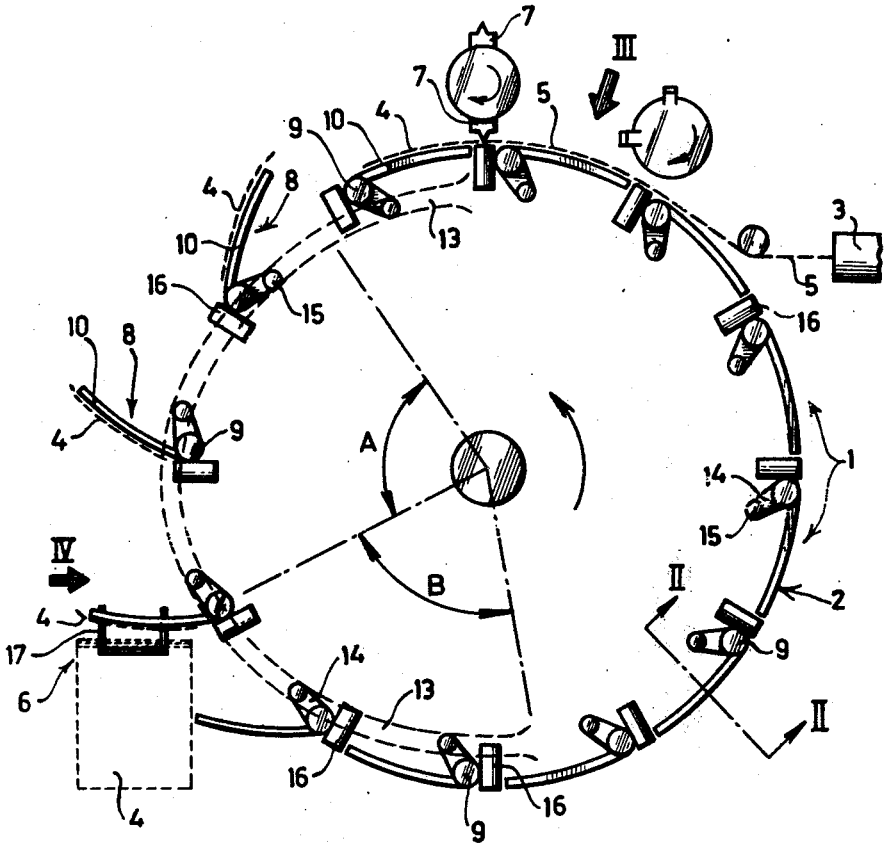
FIG. 2 is a cross-sectional view according to line II—II in FIG. 1.
Figure 2:
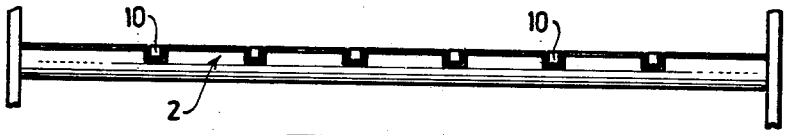

As can be seen in FIG. 1, the apparatus comprises a pivotally arranged supporting structure 1 having a mantle face 2 which, in this variant, is cylindrical. The supporting structure 1 cooperates with a (schematically indicated) production machine 3 for producing a web of foil material for thermoplastic bags 4, which web is supplied as a tube or a semi-tube 5. On the opposite side of the supporting structure 1 there is a collecting station 6 for depositing and batching lengths or sheets of foil material 4. There are means for cutting off sheets 4 from the web 5, which means, in the illustrated embodiment, comprise a heated knife 7 moving synchronously with the supporting structure 1, which knife operates upon the web 5 in cooperation with the supporting structure 1 in a manner to be described hereinafter.

Along the mantle face 2, the supporting structure 1 comprises unfoldable support members 8, each of which is arranged pivotally on an axis 9. These members have a curved shape and together form a cylindrical mantle face.

Figure 3:
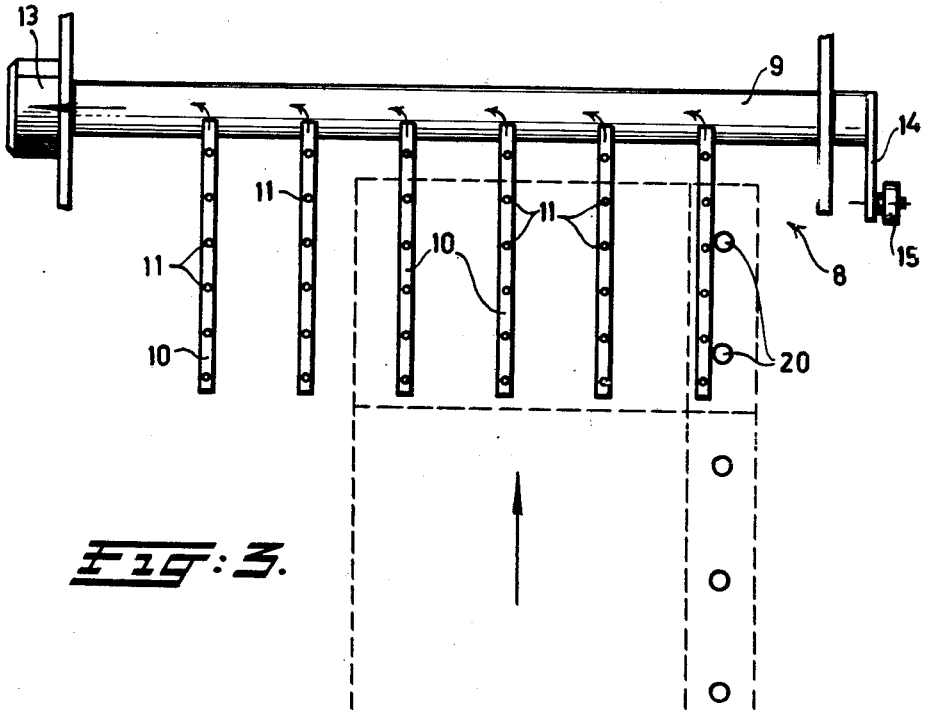
FIG. 3 is a view according to arrow III in FIG. 1.

Each of the axes 9 is located according to a generatrix of the mantle face 2, whereby the support members 8, in collapsed position, substantially form the mantle face 2 or lie flush therewith, (see FIG. 2). In the illustrated embodiment, each support member 8 has curved tubular parts 10 with perforations 11 on the side directed radially outward. The axis 9 is hollow and cooperates, on the left-hand side shown in FIG. 3, with an annular space 12 which extends substantially into an extension of the mantle face 2. The support members 8, or rather the axes 9 thereof, cover a circular path which, in this embodiment, also almost coincides with the mantle face 2.

For unfolding the members 8, control means are provided which also contribute to the collapse of said members. Unfolding takes place in a zone A upstream of the collecting station 6 and re-folding takes place in a zone B downstream of said station 6. The said control means comprise a fixed cam track 13 which extends along the annular path mentioned hereinbefore, and a lever 14 with a follower roller 15 upon the axis of each support member. Said roller 15 cooperates with the cam track 13 so as to control the unfolding and collapsing movement of each support member in said zones A and B.

The collapsing movement of the support members 8 may be supported by the action of a spring, or may even be entirely realized thereby. For the unfolding movement of the support members, a more positive control is required in order to assure that a fully unfolded condition is reached when the sheets of plastics pass the collecting station 6, so that said material can be deposited at that point and be batched in a uniform manner.

FIG. 1 shows the situation in which the foil material is supplied to the supporting structure 1 as a coherent web 5. In connection herewith, an anvil 16 is provided between adjacent support members 8 along the mantle face 2 of the supporting structure 1. From this it follows that the number of anvils 16 equalizes the number of unfoldable support members 8 in the supporting structure 1. These anvils cooperate with the knife 7 which moves in synchronism with the supporting structure 1. This knife is arranged before the zone A of the circular path and effects the separation and heat-sealing of the web of foil material 5, pretreated in the production machine 3. This is the so-called "side-weld" system in which the heated knife 7 cuts the web 5 and simultaneously produces a bead seal on both sides.

Figure 4:
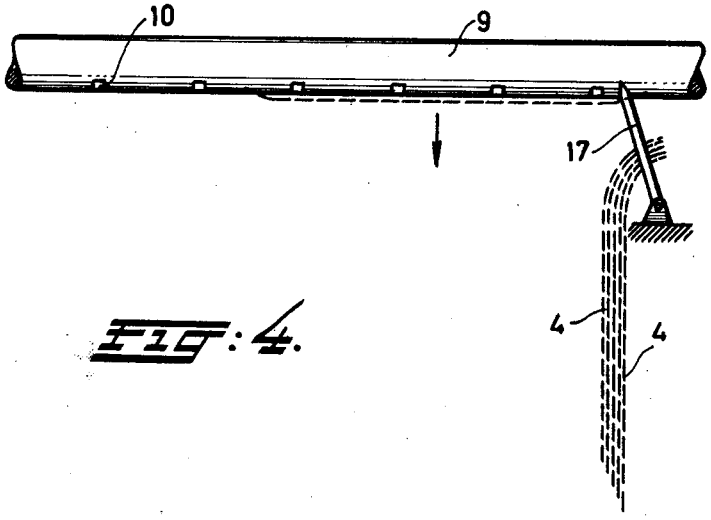
FIG. 4 is a view according to arrow IV in FIG. 1.

The collecting station 6 consists of two collecting pins 17 (FIGS. 1–4) or of a rod 18 (FIGS. 5, 6). The pins 17 are arranged at a location sidewise of the tubular portions 10 of the unfolded support members 8 (see FIG. 4). The collecting rod 18 is situated at a point in between these tubular portions 10 (see FIG. 5). When a collecting rod 18 is applied, some pins 19 may be provided so as to prevent sliding of the plastic material.

In case of application of collecting pins in the shape of a wicket (FIGS. 1 and 4), the sheets of plastic material or bags 4 are provided in advance with some holes 20 punched into the web. This punching may be carried out in the production machine 3, or a rotating punching apparatus 21 may be arranged before the knife 7 along the periphery of the supporting structure 1. This apparatus moves in synchronism together with said supporting structure 1.

The sheets or bags 4 are retained upon the support members by applying a sub-atmospheric pressure, for which purpose a considerable arcuate portion of the annular space 12 is connected with a source of sub-atmospheric pressure (not shown). When the sheet material passes the collecting station 6, said sub-atmospheric pressure may be canceled so as to facilitate detaching the lengths 4 from the support members 8.

Figure 7:
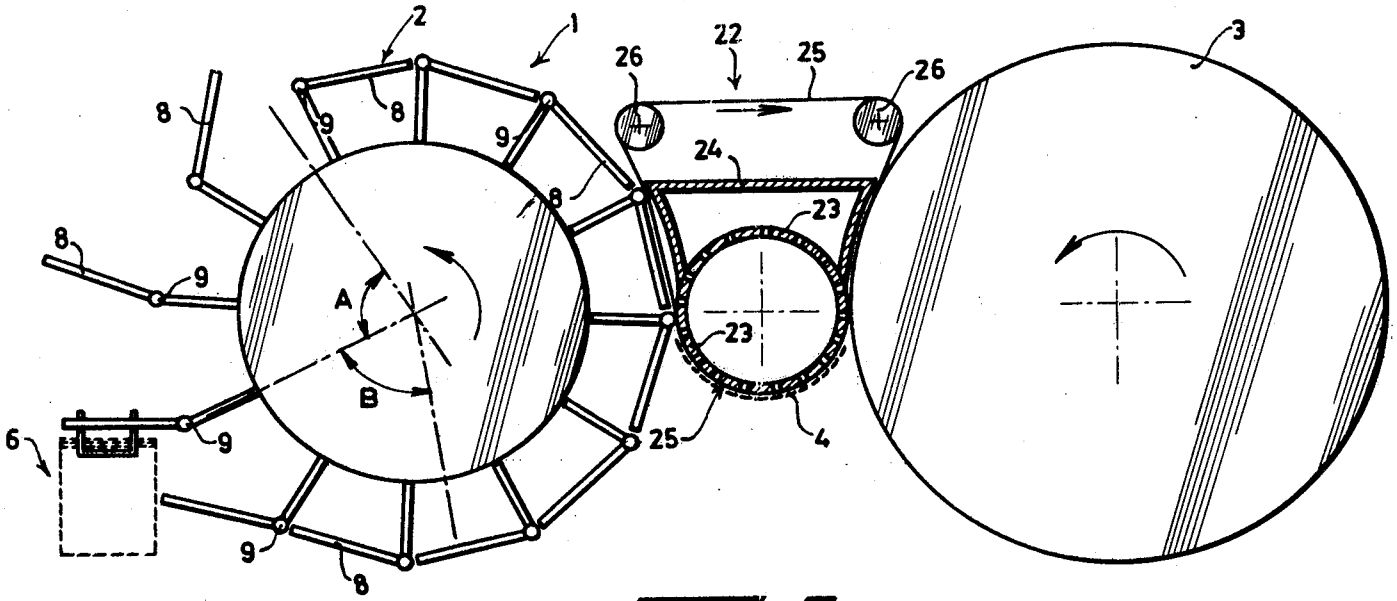
FIG. 7 shows a variant of the supporting structure.

In the described embodiment of the present apparatus, the width of the bags is determined by the ratio of velocity between the supply from the machine 3 and the circumferential velocity of the supporting structure 1. The production of bags may also be carried out on a separate drum, as in the variant of FIG. 7. In the machine 3, bags 4 are made in a conventional manner and, if desired, holes 20 are punched into the material. Between the machine 3 and the supporting structure 1, there is a transport apparatus 22 which consists of a perforated cylinder 23 having an adjoining suction box 24. This cylinder 23 is encircled by an endless perforated belt 25 guided along rollers 26. Bags 4 from the machine 3 are pressed against the belt 25 on the right-hand side of the box 24. When the cylinder 23 is reached, the bag 4 will adhere to the moving belt 25 and so detach itself from the machine 3. After the bag has passed the cylinder 23, said bag will be taken over by a support member 8 located opposite the left-hand side of the box 24 at that moment. In this variant, the bearing elements are not curved, so that, the supporting structure 1 has a polygonal mantle face 2. Furthermore, in this variant the bags 4 are delivered in the same manner as described with respect to FIG. 1. In the variant of FIG. 7 a cylindric mantle face may also be applied, whereas in the apparatus of FIG. 1 a polygonal mantle face may be used.

What is claimed is:

1. An apparatus for depositing and batching lengths or sheets of foil material at a collecting station, particularly thermoplastic bags which are delivered by a production machine in an uninterrupted flow, which apparatus comprises a rotatably mounted supporting structure with a mantle face to which foil material is supplied in the course of the operation, said supporting structure being provided along its mantle face with unfoldable support members, each of which is arranged pivotally on an axis directed according to a generatrix of said mantle face, the support members in collapsed position substantially constituting the mantle face, while control means are provided for unfolding the support members in a first zone before the collecting station and for collapsing (re-folding) the support members in a second zone beyond this station.

2. The apparatus of claim 1, wherein the control means for the support members comprise a fixed cam track arranged along at least a portion of the circular path of the support members, and a lever with a follower roller arranged on the axis of each support member, said lever cooperating with the cam track for guiding the unfolding and collapsing movement of each support member in said zones of the circular path.

3. The apparatus of claim 1, wherein each support member is provided with curved tubular parts having perforations on the radially outwardly directed side, said axis being hollow and cooperating at one end with an annular space of which at least a substantial arcuate portion is connected with a source of sub-atmospheric pressure.

4. An apparatus as defined in claim 3, wherein the collecting station comprises at least one collecting pin arranged in a location between the tubular parts of the unfolded support members or at a point sidewise of said parts.

5. The apparatus of claim 1, capable of receiving the foil material as an uninterrupted web upon the supporting structure, comprising an anvil between the adjacent support members along the mantle face of the supporting structure to cooperate with a heated knife which moves synchronously with the supporting structure, said knife being arranged before the first zone of the circular path and by means of which the side-weld bags are manufactured.

6. An apparatus as defined in claim 5, comprising a punching apparatus for punching holes near the side of the web of plastic material, said punching apparatus being arranged along the circumference of the supporting structure at a location before the knife.

* * * * *